United States Patent [19]

Pukl

[11] B 3,985,175

[45] Oct. 12, 1976

[54] FOAM PLASTIC INJECTION MOLDING

[75] Inventor: Kenneth J. Pukl, Midland, Mich.

[73] Assignee: The Dow Chemical Company, Midland, Mich.

[22] Filed: Sept. 13, 1974

[21] Appl. No.: 505,813

[44] Published under the second Trial Voluntary Protest Program on January 13, 1976 as document No. B 505,813.

[52] U.S. Cl. ..... 160/229 R; 49/501; 52/309; 52/619

[51] Int. Cl.[2] ..... E06B 3/20

[58] Field of Search ..... 49/501; 160/201, 229, 160/206, 232; 52/309, 619

[56] References Cited

UNITED STATES PATENTS

| | | | |
|---|---|---|---|
| 2,272,227 | 2/1942 | Thomas | 52/619 X |
| 2,952,313 | 9/1960 | Stroup | 160/229 R X |
| 2,975,616 | 3/1961 | Saunders | 49/501 X |
| 3,184,263 | 5/1965 | Plegat | 49/501 |
| 3,546,841 | 12/1970 | Smith et al. | 52/309 |
| 3,554,267 | 1/1971 | Brinker | 160/206 X |
| 3,714,739 | 2/1973 | Dolan | 49/501 |
| 3,815,657 | 6/1974 | Malek et al. | 160/229 R |
| 3,835,609 | 9/1974 | Oscar | 52/619 X |

*Primary Examiner*—Philip C. Kannan
*Attorney, Agent, or Firm*—Robert B. Ingraham

[57] ABSTRACT

Injection molded plastic doors having only one face of the door exposed to view in an intended installation are prepared by injection molding a foam plastic door and providing a box beam generally centrally disposed within the door on the usually nonvisible face. Lightweight and high strength are obtained. Such doors are very satisfactory for folding closet door applications.

7 Claims, 4 Drawing Figures

FOAM PLASTIC INJECTION MOLDING

Many articles are fabricated from synthetic resins by injection molding. In recent years due to the scarcity and expense of wood and the labor required for its fabrication, synthetic resins or plastic material have become more widely employed for applications previously considered to be suitable only for wood or like material.

Cabinet doors having the appearance and surface texture approaching that of wood have been fabricated from expandable synthetic resin thermoplastic material such as expandable polystyrene, impact polystyrene or rubber reinforced polystyrene. Such foam injection moldings frequently have durability and texture which approximates that of wood and oftentimes are more dimensionally stable in that the plastic materials are more moisture resistant than wood. Several attempts have been made to prepare larger doors from foamed synthetic resinous materials or foamed plastics by injection molding, however, the problem of larger doors is substantially more difficult than the problem of molding smaller doors. Attempts have been made to prepare injection molded larger doors, that is doors having a height of about 6 feet or more, by injection molding two generally rectangular hollow pans and joining such pans by the edges or flanges to form a hollow door. Such doors having two finished sides can be considered as a two-sided door and suitable for applications where one would, in normal use, have a view of both sides of the door. There are applications for what may be considered one-sided doors, that is a door which has one side which is normally viewed by a person using the door (the visible side) and a second side which is an oppositely disposed side which is rarely if ever seen by a person using the door (the nonvisible side). Folding doors for closets have been considered as one-sided doors. For example, if one assumes a closet fitted with a door assembly which comprises four doors, two jamb doors pivotally supported at opposite jambs of the doorway and two lead doors pivotally affixed to the jamb doors provide a closet door assembly wherein the edge of the lead door most remote from the jamb door is guided by a track or way disposed in the upper edge and/or on the sill portion of the doorway. Such a door assembly in normal use presents only one readily visible surface of the doors assuming the closet is not of a dimension such that a person normally enters the closets when using it but folds one or both of the two assemblies of two doors each. The inner surface of the door is hidden from view and for most applications need not have the aesthetically pleasing surface that is required on the opposite or visible side of the door. Generally such folding doors can readily be prepared from wood, plastic, metal or other material, however, particularly desirable and attractive doors can be prepared by the injection molding of synthetic resinous foamable thermoplastic material to provide a surface which is readily finished in such a manner that is difficult to distinguish it from a natural wood or the door can be provided with surfaces characteristic of plastic.

Attempts have been made to substitute plastics for wood in the preparation of such folding doors. Rigidity is required in each of the doors or door elements such that the hinged door assemblies do not sag, warp or twist unduly when extended from the closed position. Such assemblies must have sufficient rigidity or resistance to bending and twisting under their own weight or additional force applied when opening or closing that they are not unexpectedly dislodged from the associated guide, track or way when the door is opened with more force than is normally required to operate such a door assembly. It is obvious that the resistance to bending or twisting of such an assembly is readily increased by increasing the thickness of the door and increasing the amount of foamed plastic used in the door. In the interest of providing maximum value to the buyer or user of such a door it is desirable that maximum rigidity be obtained employing a minimal amount of plastic material in that initial costs are reduced, lower or reduced shipping and installation costs are made possible because of a lighter weight door. Such doors are more easily operated because of their lower weight and lack of mass.

It would be more desirable if there were available an improved door of foam plastic material.

It would be desirable if there would be available an improved molded foam plastic door with a relatively high resistance to bending and twisting.

It also would be desirable if there were available improved principally injection molded plastic doors which could be readily provided with a decorative surface.

These features or other advantages in accordance with the present invention are achieved in a foamed synthetic resinous plastic door, the foam plastic door having a generally rectangular configuration, the door having a finished or exposed surface and a nonexposed or hidden surface, the door having peripheral flange portion of generally rectangular configuration extending away from and generally normal to the exposed surface, the door having first and second major edges generally oppositely disposed, the major edges being in generally parallel relationship, the door having first and second end portions generally oppositely disposed, at least first and second reinforcing members affixed to the hidden surface, the first and second reinforcing members being in generally parallel relationship, the first and second reinforcing members extending between flange portions at the first end portion and the second end portion, the reinforcing members being affixed to the nonexposed surface and adjacent flange portions, a plate-like member is disposed generally adjacent the nonexposed side and remote from the exposed side, the plate-like member affixed to said reinforcing members at locations remote from nonexposed side and the plate-like planar member extending at least half the distance that the ribs extend, the plate-like member being generally centrally located relatively to the door.

Also comtemplated within the scope of the present invention is a door assembly comprising at least two of the hereinbefore described doors, each affixed to each other along a major edge thereof.

Further features and advantages of the present invention will become more apparent from the following specification taken in connection with the drawing wherein.

Figure 1:
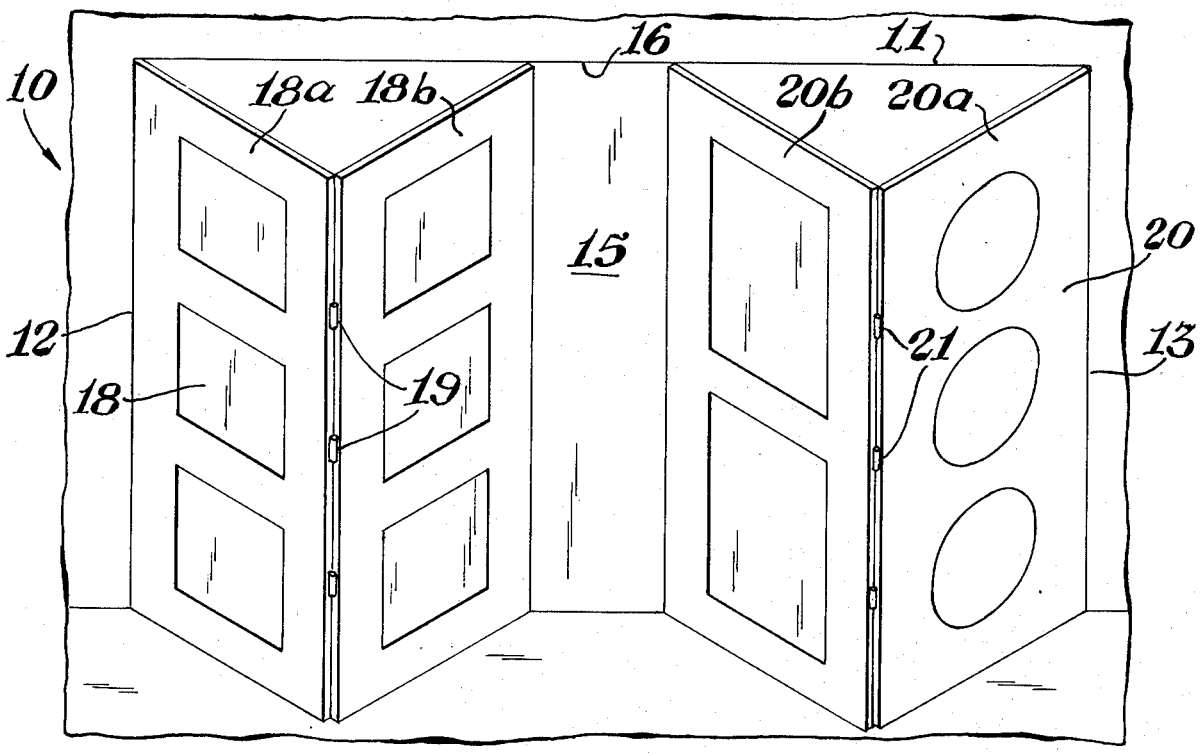
FIG. 1 is a schematic representation of a pair of bi-fold doors in accordance with the present invention.

In FIG. 1 there is schematically represented an assembly of doors in accordance with the present invention generally designated by the reference numeral 10. The door assembly 10 comprises a door frame 11 having first door jamb 12 and second door jamb 13. The frame 11 defines a doorway or opening 15 bounded on the upper surface by upper frame member 16 having therein a way or guide means not shown. A first door assembly 18 is disposed adjacent to jamb 12. The first door assembly 18 comprises a first or jamb door 18*a* and a second or lead door 18*b*. The jamb door 18*a* is hingedly affixed to the jamb 12 by means of hinges not shown. The lead door 18*b* is hingedly affixed to the jamb door 18 at an edge remote from and generally parallel to the jamb 12 by means of hinges 19. A second door assembly 20 is disposed adjacent the jamb 13, the assembly 20 is of generally similar construction to the assembly 18, the assembly 20 comprises a jamb door 20*a* and a lead door 20*b*. The jamb door 20*a* is hingedly affixed to the jamb 13. The lead door 20*b* is hingedly affixed to the jamb door 20*a* at a location remote from its hinged connection to the jamb 13 by means of the hinges 21. The door assembly 10 is disposed in a partially open configuration. Each of the doors 18*a*, 18*b*, 20*a*, and 20*b* show an exterior or exposed surface. Each of the doors 18*a*–20*b* have a remote or hidden major surface not shown.

Figure 2:
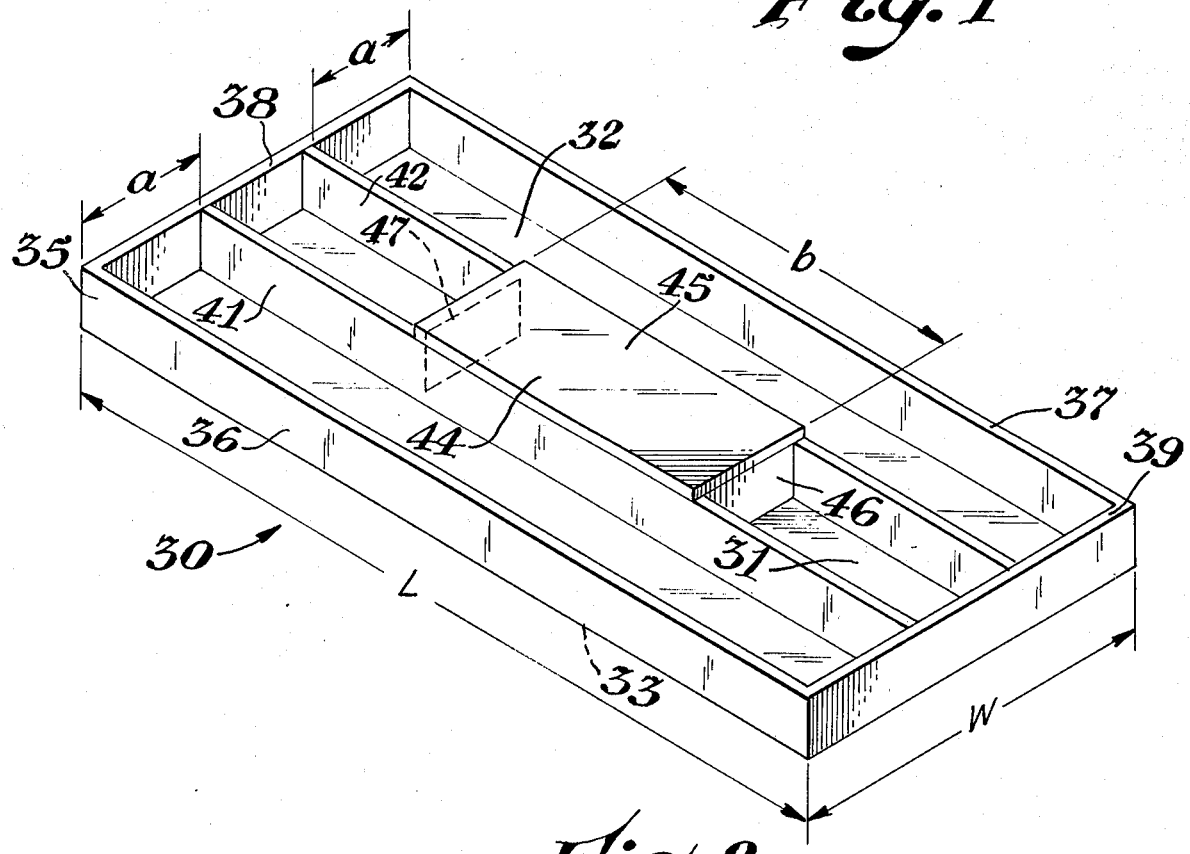
FIG. 2 is a schematic representation of a view of the rear or nonexposed surface of a door in accordance with the invention.

In FIG. 2 there is schematically depicted a door in accordance with the present invention generally designated by reference numeral 30 comprising a generally planar facing member 31. Member 31 has an exposed or visible face 32 and hidden or nonvisible face 33. The generally planar member 31 has a generally rectangular configuration with a length $l$, a width of $w$ as indicated by the dimension lines in FIG. 2. The planar member 31 has an integral peripheral flange 35 which extends away from the exposed face 32 and is affixed to the hidden face 33 of the face member 31. The flange 35 comprises a first edge portion 36 and a second oppositely disposed edge portion 37, the portions 36 and 37 are generally parallel and are disposed at opposite major edges of facing member 31. The flange 35 has end or top and bottom portions 38 and 39 extending the width of the planar member 31. First and second rib members 41 and 42 extend between flange portions 38 and 39. The rib members 41 and 42 are disposed on the remote or hidden face 33 and affixed to the planar member 31. The rib members 41 and 42 are spaced a distance a from the nearest of the major edge flange portion 36. The rib members 41 and 42 are generally symmetrically disposed about a center line of the door 30 which extends parallel to the flange portions 36 and 37 and the ribs 41 and 42. A box beam portion 44 having length $b$ and a width of about $w-2a$ is generally centrally disposed within the door 30. The box portion comprises a first or box end plate 45 affixed to the ribs 41 and 42. The plate 45 extends generally parallel to the planar member 31 and is spaced therefrom by ribs 41 and 42. A first end plate 46 extends between the ribs 41 and 42 and the plate 45. The first end plate 46 is affixed to the ribs 41 and 42, the planar member 31 of the plate 45. A similar box end plate 47 is remotely disposed from plate 46 at the opposite end of plate 45 and is positioned in a plane generally parallel to a plane containing the plate 46. The plate 47 is affixed in a manner generally similar to that of plate 46. The door 30 of FIG. 2 beneficially is prepared of a foamed synthetic resinous thermoplastic material by injection molding of an assembly as generally depicted in FIG. 2 with the exception that plate 45 is omitted during the injection molding operation and is added after the removal of the door from the mold. The plate 45 advantageously is of foam plastic material such as is employed in the door. However, the plate 45 may beneficially be a solid plastic sheet, plywood, hardboard, sheet metal or the like. For example, an 8 inch wide impact polystyrene sheet, polyvinyl chloride sheet or other thermoplastic material which is readily affixed to the ribs by means of suitable adhesives, heat sealing or other well-known joining means employed with synthetic resinous materials is very satisfactory. For most doors, in accordance with the present invention which are employed as closet doors the length of the door will be from about 6 feet to about 7 ½ feet. The width will vary from about 12 inches to 30 inches and most often from about 18 inches to about 20 inches. In order to obtain maximum stiffness of the door, it is desirable that $w/a$ lie within the region of about 2 to 5 and beneficially from about 2.5 to 3.5 and the length of the plate-like element be from about L to L/2. Beneficially optimum stiffness in a door of the present invention is obtained when the plate-like element is centrally disposed between the opposed flanges. In most instances where the door is about 72 inches in height and has a width 18 inches with $w/a$ equal to 3, very satisfactory doors have been obtained when the flange 35 has a thickness of about 3/16 to ¼ inch and a depth of about 2 inches and about 1/12 to 2 inches, the ribs 41 and the planar element 31 are about ¼ inch in thickness and the plastic foam is impact polystyrene and the specific gravity of the final molding is about 0.72. The plates 45, 46 & 47 being 0.10 inch thick impact polystyrene and solvent bonded to the ribs 41 and 42.

Figure 3:
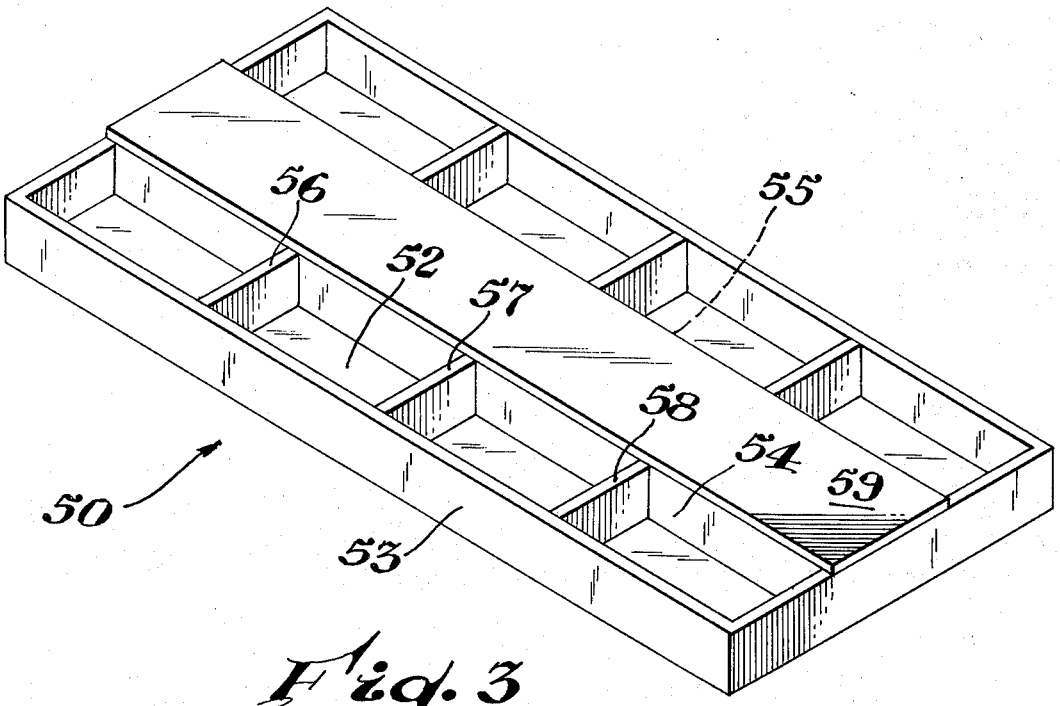
FIG. 3 is a view similar to FIG. 2 of alternate embodiment of the invention.

In FIG. 3 there is depicted an alternative door in accordance with the invention generally designated by the reference numeral 50. The door 50 is generally similar in construction to the door of FIG. 2. The door comprises a generally planar element 52 having peripheral flange 53, longitudinal ribs 54 and 55 integrally molded with transverse rib members 56, 57 and 58. The transverse rib members 56, 57 and 58 extend generally in the direction of the door while the ribs 54 and 55 extend the length of the door. A plate 59 extends the length of the door and is adhered to the ribs 54 and 55 and the adjacent portions of the transverse members 56, 57 and 58. The door 50 of FIG. 3 requires the same dimensional relationship employed with the door of FIG. 2.

The embodiment of FIG. 3 is a configuration which is particularly desirable if the door is to have maximum rigidity or with minimum weight and provide a configuration which can be readily molded.

Figure 4:
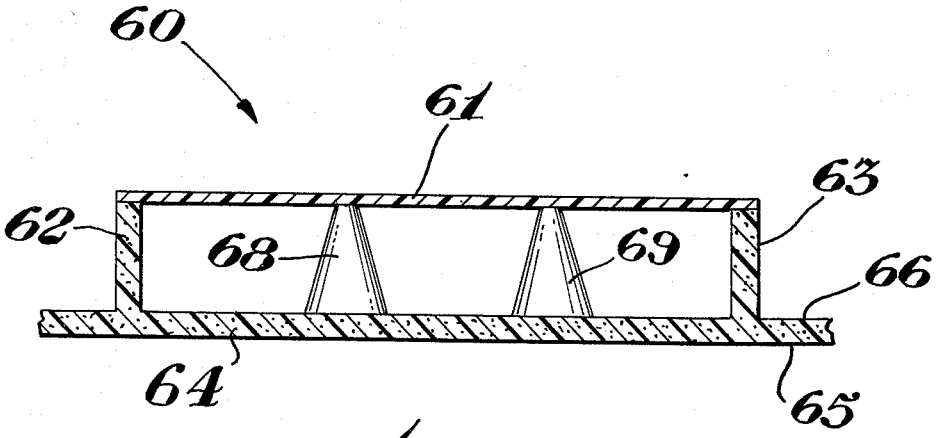
FIG. 4 is a schematic representation of a partial sectional view of a stiffened door of the present invention.

In FIG. 4 there is schematically depicted a cross-sectional view of an alternate form of a box assembly generally designated as numeral 60. The box 60 comprises a plate or stiffening member 61, a first rib member 62, a second rib member 63. The rib members 62 and 63 are in arrangement generally as the rib members of FIGS. 2 and 3. A planar sheet or facing element 64 is affixed to the ribs 62 and 63, remote from the plate 61. The planar member 64 has a first or outer face 65 and a second or hidden face 66. First and second support members 68 and 69 are disposed between the ribs 62 and 63, support members 68 and 69 are integrally molded on the face 66 of the planar member 64 and adhered to the plate 61.

The embodiment of FIG. 4 is particularly desirable where simplified mold construction is desired. The support members 68 and 69 can have generally frustoconical configuration and simplified manufacture of the mold. Doors in accordance with the present invention are readily fabricated from a wide variety of plastics in various sizes providing stiff lightweight doors which are eminently satisfactory.

Doors in accordance with the present invention may be finished in a manner similar to that employed with known foam plastic door hinges and other hardware can be attached in conventional manners such as by means of adhesive screws, bolts or other fastening means including heat sealing and the like.

Doors prepared in accordance with the present invention have been found very satisfactory for closet use and like applications.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A foamed synthetic resinous plastic door, the foam plastic door having a generally rectangular configuration, the door having a finished or exposed surface and a nonexposed or hidden surface, the door having a peripheral flange portion of generally rectangular configuration extending away from and generally normal to the exposed surface, the door having first and second major edges generally oppositely disposed, the major edges being in generally parallel relationship, the door having first and second end portions generally oppositely disposed, at least first and second reinforcing members affixed to the hidden surface, the first and second reinforcing members being in generally parallel relationship, the first and second reinforcing members extending between flange portions at the first end portion and the second end portion, the reinforcing members being affixed to the nonexposed surface and adjacent flange portions, a plate-like member is disposed generally adjacent the nonexposed side and remote from the exposed side, the plate-like member affixed to and terminating at said reinforcing members at locations remote from nonexposed side and the plate-like planar member extending at least half the distance that the ribs extend, the plate-like member being generally centrally located relative to the door.

2. The door of claim 1 having a width $w$ wherein the first and second reinforcing members are spaced from the nearest adjacent major edges, a distance of $a$, and $w/a$ is from 2 to 5.

3. The door of claim 2 wherein $w/a$ is from 2.5 to 3.5.

4. The door of claim 3 wherein $w/a$ is about 3.

5. The door of claim 1 including a plurality of transverse rib members extending generally normal to the reinforcing members and affixed to the hidden surface.

6. The door of claim 1 wherein the plate-like member is adhered to plates extending between the reinforcing members and affixed to the hidden surface, the plates extending generally normally to the hidden surface and being disposed generally adjacent the first and second end portions.

7. Two doors in accordance with claim 1 each hingedly affixed to the other along a major edge thereof and when in generally coplanar relationship having their visible surfaces generally coplanar.

* * * * *